United States Patent [19]

Lee

[11] Patent Number: 5,020,240

[45] Date of Patent: Jun. 4, 1991

[54] FABRIC SOFTENER DISPENSER

[75] Inventor: Ling H. Lee, Memphis, Tenn.

[73] Assignee: WAGI Partnership, Memphis, Tenn.

[21] Appl. No.: 486,832

[22] Filed: Mar. 1, 1990

[51] Int. Cl.[5] ..... F26B 19/00

[52] U.S. Cl. ..... 34/60; 34/9; 34/12

[58] Field of Search ..... 34/60, 12, 9, 71, 9, 34/95

[56] References Cited

U.S. PATENT DOCUMENTS

| | | | |
|---|---|---|---|
| 3,245,737 | 4/1966 | Kleinhans | 312/31 |
| 3,698,095 | 10/1972 | Grand et al. | 34/60 X |
| 3,713,614 | 1/1973 | Taylor | 248/205 |
| 3,736,668 | 6/1973 | Dillarstone | 34/60 |
| 4,569,462 | 2/1986 | Belokin | 222/180 |
| 4,570,888 | 2/1986 | Evans | 248/205 |
| 4,660,715 | 4/1987 | Anastos | 206/0.8 |

*Primary Examiner*—Henry A. Bennet
*Attorney, Agent, or Firm*—Walker & McKenzie

[57] ABSTRACT

A fabric softener dispenser for being mounted within the drying chamber of a clothes dryer. The dispenser has a housing for receiving a replaceable solid fabric softener cartridge. Adjustment structure is provided to allow the solid fabric softener cartridge to be easily advanced in the housing as the distal end of the solid fabric softener cartridge is worn down by contact with clothes being dried in the drying chamber.

17 Claims, 1 Drawing Sheet

FABRIC SOFTENER DISPENSER

BACKGROUND OF THE INVENTION

1. Field of the Invention

The present invention relates, in general, to fabric softeners and more specifically to a dispenser for fitting within the drying chamber of a clothes dryer to dispense fabric softener as clothes are dried.

2. Information Disclosure Statement

One prior art method of applying a fabric softener to clothes is to add a liquid or powder type fabric softener to the clothes during a washing cycle in a washing machine. Another prior art method of applying a fabric softener to clothes is to add a piece of fabric softener impregnated fabric into the drying chamber of a clothes dryer as the clothes are being dried.

A preliminary patentability search in class 248, subclasses 205.1, 206.5 and class 206, subclass 77.1 produced the following patents: Belokin, U.S. Pat. No. 4,569,462; Anastos, U.S. Pat. No. 4,660,715; Kleinhans, U.S. Pat. No. 3,245,737; Taylor, U.S. Pat. No. 3,713,614; and Evans, U.S. Pat. No. 4,570,888. The above patents disclose various containers, attachments, and the like for being attached to the side of a dryer, a refrigerator door, etc., and may, therefore, relate in general to the structure of the present invention.

None of the known prior art discloses or suggests the present invention. More specifically, nothing in the known prior art discloses or suggests a fabric softener dispenser including housing means for holding a solid fabric softener cartridge, the housing means having a cavity for receiving the second end of the solid fabric softener cartridge; and attachment means for attaching the housing means to a clothes dryer with the first end of the solid fabric softener cartridge extending into the drying chamber of the clothes dryer for contacting the clothes as the clothes are dried.

SUMMARY OF THE INVENTION

The present invention is directed toward providing a fabric softener dispenser that can be mounted within the drying chamber of a clothes dryer and which holds a partially exposed, replaceable solid fabric softener cartridge.

The fabric softener dispenser of the present invention includes housing means for holding a solid fabric softener cartridge, the housing means having a cavity for receiving the second end of the solid fabric softener cartridge; and attachment means for attaching the housing means to a clothes dryer with the first end of the solid fabric softener cartridge extending into the drying chamber of the clothes dryer for contacting the clothes as the clothes are dried.

The advantages of the present invention over prior art methods of applying fabric softener to clothes in a clothes dryer include:

1. The present invention requires less labor to accomplish the same purpose.

2. The present invention does not require a piece of fabric to be disposed of after each load.

3. The operating costs of the present invention (i.e., the costs after investing in the basic housing means) is less per load of drying.

4. The present invention does not make any annoying tumbling noise inside the drum of the clothes dryer.

5. During the drying process, the distribution of the fabric softener chemical is more uniform using the present invention (the impregnated strip sometimes gets caught between pieces of clothes during the whole drying cycle).

The preferred embodiment of the dispenser of the present invention includes a cylindrical housing having a magnet attached to one end and holding a partially exposed solid fabric softener cartridge element at the other end. The magnetic base is easily attached to the inside of a loading door of a typical clothes dryer or to the inside circumference of the tumbler drum of the clothes dryer. As clothing is tumbled within the drying chamber, chemicals from the exposed end of the solid fabric softener cartridge element will gradually rub off onto the clothing and, in turn, from piece to piece inside the tumbler drum. As the cartridge element is worn down, a simple mechanism allows the remaining cartridge element to be advanced by a measured amount.

DESCRIPTION OF THE PREFERRED EMBODIMENT

The preferred embodiment of the fabric softener dispenser 11 of the present invention is used in combination with an expendable solid fabric softener cartridge 12 and a typical gas or electric clothes dryer 13.

Figure 1:
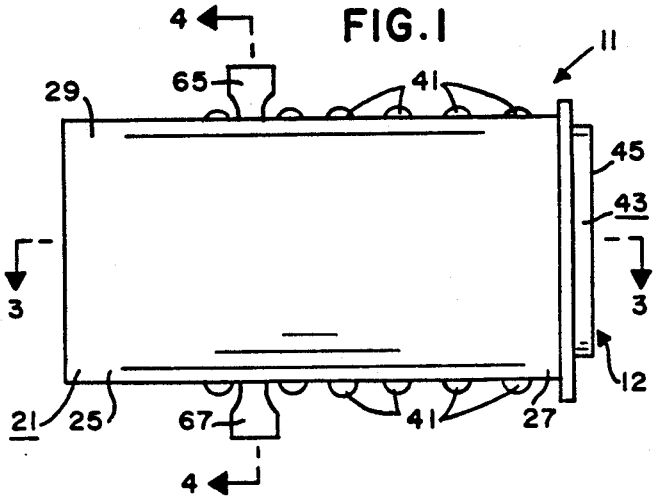
FIG. 1 is a side elevational view of the fabric softener dispenser of the present invention.
Figure 2:
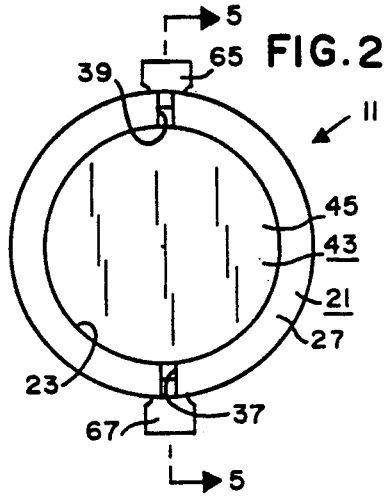
FIG. 2 is a right end elevational view thereof.
Figure 3:
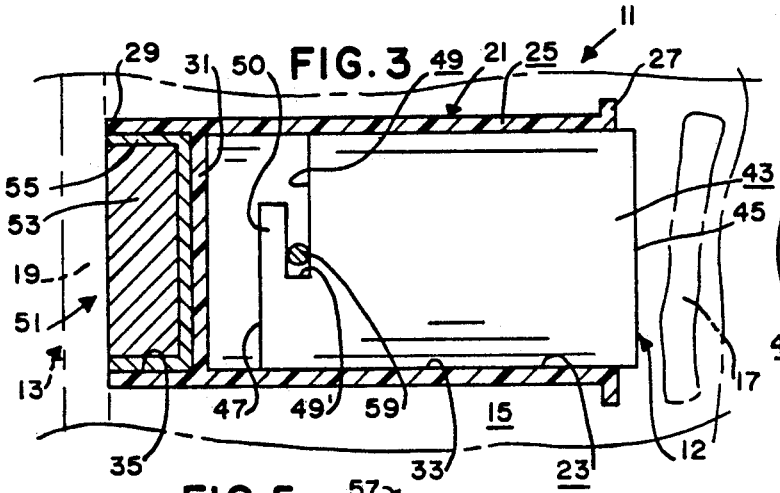
FIG. 3 is a sectional view substantially as taken on line 3—3 of FIG. 1 and showing a portion of a clothes dryer in broken lines.

The clothes dryer 13 is shown diagrammatically in FIG. 3 and may be of any well known construction and operation. As will be apparent to those skilled in the art, the clothes dryer 13 has a drying chamber 15 for receiving a quantity of clothes 17 to be dried and a loading door 19 through which the clothes 17 can be loaded into and removed from the drying chamber 15. At least a portion of the interior side of the loading door 19 is preferably made of steel or some other ferromagnetic material.

Figure 5:
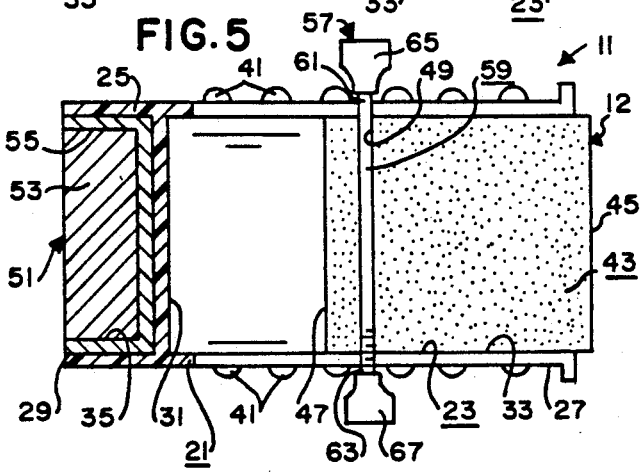
FIG. 5 is a sectional view substantially as taken on line 5—5 of FIG. 2, but showing the solid fabric softener cartridge thereof in an advanced position.

The dispenser 11 includes housing means 21 for holding the solid fabric softener cartridge 12. The housing means 21 has a cavity 23 for receiving one end of the solid fabric softener cartridge 12. The cavity 23 is preferably shaped and sized so as to allow the solid fabric softener cartridge 12 to easily slide therein while protecting and supporting all but the outer, exposed end of the solid fabric softener cartridge 12 as clearly shown in FIGS. 3 and 5. The housing means 21 preferably consists of an elongated, substantially hollow cylindrical housing member 25 having a first end 27 for extending into the drying chamber 15 and having a second end 29 for being attached to the loading door 19 of the clothes dryer 13 (see FIG. 3). The cavity 23 (i.e., the interior of the housing member 25) is preferably divided by a wall 31 into a first part 33 and a second part 35 for reasons which will hereinafter become apparent. The first part 33 of the cavity 23 extends from the first end 27 of the housing member 25 toward the wall 31 and the second part 35 of the cavity 23 extends from the second end 29 of the housing member 25 toward the wall 31 as clearly shown in FIGS. 3 and 5. The first part 33 of the cavity 23 is preferably substantially deeper than the second part 35 thereof. The housing member 25 preferably has a first slot 37 extending into the cavity 23 along one side thereof, and a second slot 39 extending into the cavity 23 along the opposite side thereof. Thus, the slots 37, 39 are 180 degrees apart from one another. Each slot 37, 39 extends from the first end 27 of the housing member 25 toward the wall 31. The housing means 21 preferably includes a plurality of spaced apart protuberances 41 along substantially the entire length of each side of each slot 37, 39 for reasons which will hereinafter become apparent. Rather than protuberances 41, the housing means 21 may have a plurality of spaced apart notches (not shown) in the sides of each slot 37, 39 for the same reasons as the protuberances 41 and as will hereinafter become apparent. The housing means 21 may be manufactured in various manners as will now be apparent to those skilled in the art. For example, the housing means 21 may be molded out of plastic or the like.

Figure 8:
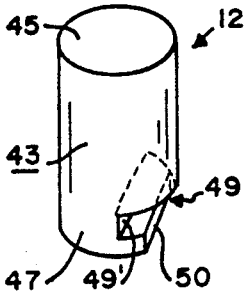
FIG. 8 is a reduced perspective view of a solid fabric softener cartridge of the fabric softener dispenser of the present invention.

The solid fabric softener cartridge 12 preferably consists of an elongated cylinder 43 of a solid fabric softener of any well known chemistry and chemical composition. The cylinder 43 has a first or exposed end 45 for extending outward from the housing means 21 and a second end 47 for extending into the cavity 23. The first end 45 of the cylinder 43 extends outward from the housing means 21 into the drying chamber 15 in a manner so that the clothes 17 will rub against the first end 45 as the clothes 17 are being dried in the drying chamber 15. Thus, as the clothes 17 are tumbled about the drying chamber 15, chemicals from the exposed end 45 of the elongated cylinder will be rubbed off gradually onto the clothes 17 and, in turn, from one piece of clothing to another inside the drying chamber 15, to thereby soften or otherwise threat the clothes 17, etc., as will now be apparent to those skilled in the art. A transverse hole or slot 49 is preferably provided across the fabric softener cylinder 43 adjacent the second end 47 thereof as clearly shown in FIG. 8 for reasons which will hereinafter become apparent. The slot 49 is preferably cut through substantially half of the cylinder 43 and thus has a half-circle or D-shape as shown in FIG. 8. A tab 50 is thus formed between the slot 49 and the second end 47 of the cylinder 43 as clearly shown in FIG. 8. The tab 50 preferably only extends substantially halfway from the bottom 49' of the slot 49 to the outer circumference of remainder the cylinder 43 for reasons which will hereinafter become apparent.

The dispenser 11 includes attachment means 51 for attaching the housing means 21 to the clothes dryer 13 with the first end 45 of the fabric softener cylinder 43 positioned within the drying chamber 15. The attachment means 51 preferably includes a magnet 53 coupled to the second end 29 of the housing member 25 of the housing means 21 for magnetically and removably attaching the housing means 21 to the interior side of the loading door 19 of the clothes dryer 13. The attachment means 51 preferably includes a ferromagnetic cup 55 for fixedly receiving the magnet 53 and for being fixedly attached to the second end 29 of the housing member 25 of the housing means 21. More specifically, the ferromagnetic cup 55 may be constructed out of steel or some other ferromagnetic material and is preferably sized so as to tightly fit into the second part 35 of the cavity 23. The cup 55 may be fixedly secured to the second end 29 of the housing member 25 by friction, glue, etc., as will now be apparent to those skilled in the art. The magnet 53 is preferably disc-shaped and is preferably sized so as to tightly fit into the cup 55. The magnet 53 may be permanently attached to the cup 55 by friction, glue, etc., as will now be apparent to those skilled in the art. The ferromagnetic cup 55 will enhance the attaching power of the magnet 53 onto the ferromagnetic interior side of the loading door 19 of the clothes dryer 13 according to a well-known principle of physics and as will now be apparent to those skilled in the art.

Figure 6:
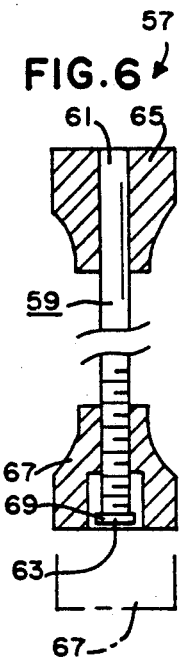
FIG. 6 is a sectional view of a first embodiment of an adjustment means of the fabric softener dispenser of the present invention with portions thereof broken away for clarity and with a moved position shown in broken lines.
Figure 7:
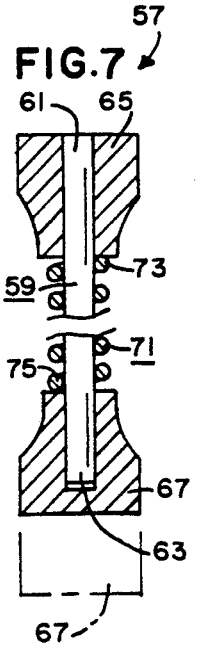
FIG. 7 is a sectional view of a second embodiment of an adjustment means of the fabric softener dispenser of the present invention with portions thereof broken away for clarity and with a moved position shown in broken lines.

The dispenser 11 preferably includes adjustment means 57 for allowing the solid fabric softener cartridge 12 to be advanced out of the housing means 21 as the first end 45 of the fabric softener cylinder 43 is worn down by contact with the clothes 17. The adjustment means 57 preferably includes a rod 59 for extending through the slots 37, 39 in the housing member 25 and through the slot 49 across the fabric softener cylinder 43. The rod 59 has a length somewhat longer than the diameter of the housing means 21 and has a first end 61 and a second end 63. The opposite ends 61, 63 of the rod 59 extend outward of the housing means 21. A first knob or grip member 65 is preferably fixedly attached to the first end 61 of the rod 59. A second knob or grip member 67 is preferably movably attached to the second end 63 of the rod 59 for movement between a first position as shown in solid lines in FIGS. 1, 4, 6 and 7 and a second position as shown in broken lines in FIGS. 6 and 7. When in the first position, the inner ends of the grip members 65, 67 will engage the outer side of the cylinder 25 of the housing means 21 to hold the adjustment means 57 in place. Additionally, the inner ends of the grip members 65, 67 will be positioned between a plurality of protuberances 41 (or within two opposed notches) which will help hold the adjustment means 57 in place as will now be apparent to those skilled in the art. The second grip member 67 may be movably coupled to the rod 59 in various specific manners. Thus, in a first embodiment as shown in FIG. 6, the second end 63 of the rod 59 is externally threaded and the second grip member 67 has an internally threaded aperture for allowing the second grip member 67 to be merely rotated between the first and second positions as will now be apparent to those skilled in the art. An enlarged portion 69 may be provided on the second end 63 of the rod 59 as shown in FIG. 6 to prevent the second grip member 67 from being screwed off of the rod 59 as will now be apparent to those skilled in the art. In a second embodiment as shown in FIG. 7, the second grip member 67 is slidably mounted on the rod 59 and a coil spring 71 extends between the first and second grip members 65, 67 to normally hold the grip members 65, 67 in the first position. Thus, the first end 73 of the coil spring 71 may be fixedly attached to the first grip member 65 by welding or the like and the second end 75 of the coil spring 71 may be fixedly attached to the second grip member 67 by welding or the like to allow the second grip member 67 to be merely pulled to the second position. The spring 71 has a resting length that is somewhat shorter than the diameter of the housing means 21. In the second embodiment, the outer end of the aperture in the second grip member 67 for slidably receiving the second end 63 of the rod 59 is preferably closed (i.e., blind) as shown in FIG. 7 to limit the minimal distance between the two grip members 65, 67. In either embodiment, the first grip member 65 is preferably fixedly attached to the first end 61 of the rod 59 by friction, glue, or the like, as will now be apparent to those skilled in the art. The thickness of the slot 49 in the fabric softener cylinder 43 is preferably slightly more than the diameter of the rod 59 and coil spring 71.

Figure 4:
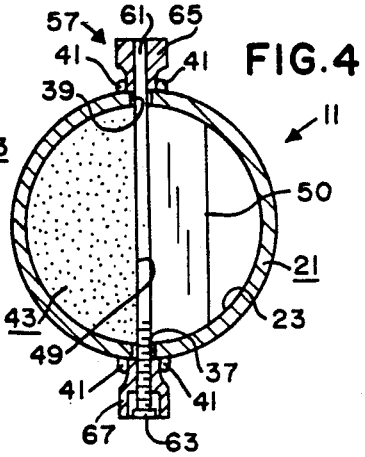
FIG. 4 is a sectional view substantially as taken on line 4—4 of FIG. 1.

To use the preferred embodiment of the dispenser 11, the housing means 21 is merely attached to the interior side of the loading door 19, preferably near the bottom of the door 19 (e.g., near the 6 o'clock position when the door 19 is closed) using the magnet 53. An alternative method is to attach the housing means 21 to the inside rim wall of the tumbler drum of the clothes dryer 13. The housing means 21 can be easily moved, removed, or serviced since it is attached only by the magnet 53. Next, the rod 59 of the adjustment means 57 is placed in the slot 49 of the fabric softener cylinder 43 with the first and second grip members 65, 67 located on opposite sides of the cylinder 43. The unit (i.e., the fabric softener cylinder 43 and the coupled adjustment means 57) can then be inserted into the first part 33 of the cavity 23 of the housing means 21 with the first and second ends 61, 63 of the rod 59 extending through the first and second slots 37, 39, respectively, and with the first and second grip members 65, 67 located on the outside of the housing member 25 of the housing means 21 as shown in FIG. 4. Since the tab 50 only extend substantially half way between the bottom 49' of the slot 49 and the outer circumference of the remainder of the cylinder 43, it will keep the cylinder 43 from becoming disengaged from the adjustment means 57 but will not hinder the attachment of the cylinder 43 to the adjustment means 57 as will now be apparent to those skilled in the art. With the second grip member 67 in the second position, the unit can be easily adjusted in the cavity 23 until only a desired amount of the outer or distal portion of the first end 45 of the fabric softener cylinder 43 is exposed and extends outward of the housing means 21. More specifically, by moving the second grip member 67 to the second position, the unit can be easily slid back and forth in the cavity 23 with the first and second grip members 65, 67 riding over the protuberances 41 (or notches) as will now be apparent to those skilled in the art. However, when the second grip member 67 is moved back to the first position, the first and second grip members 65, 67 will grip the exterior surface of the housing member 25 to hold the unit in place. The location of the inner ends of the grip members 65, 67 between a group of protuberances 41 (or an opposed pair of notches) will also hold the unit in place as will now be apparent to those skilled in the art. As the clothes 17 tumble past the first end 45 of the cylinder 43, the first end 45 is gradually worn down. Thus, periodically, the second grip member 67 is moved to the second position and the unit is slid outward to advance the first end 45 into the drying chamber 15 as will now be apparent to those skilled in the art. The plurality of protuberances 41 (or notches) will allow the unit to be easily advanced a measured amount (i.e., from one group of protuberances 41 to the adjacent group for one measured amount) as will now be apparent to those skilled in the art. Further, the cartridge 12 will occasionally need to be replaced with a new, fresh cartridge 12 by merely removing the unit completely from the housing means 21, removing the rod 59 from the slot 49 of the old cartridge 12, inserting the rod 59 in the slot 49 of a new, fresh cartridge 12, and then inserting the new unit into the first part 33 of the cavity 23 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. The combination with a clothes dryer and a solid fabric softener cartridge, of a fabric softener dispenser, said clothes dryer having a drying chamber for receiving clothes to be dried, said solid fabric softener cartridge having a first end and a second end, said fabric softener dispenser comprising:

(a) housing means for holding said solid fabric softener cartridge; said housing means having a cavity for receiving said second end of said solid fabric softener cartridge;

(b) attachment means for attaching said housing means to said clothes dryer with said first end of said solid fabric softener cartridge extending into said drying chamber of said clothes dryer for contacting said clothes as said clothes are dried; and (c) adjustment means for allowing said solid fabric softener cartridge to be advanced out of said cavity of said housing means as said first end of said solid softener cartridge is worn down by contact with said clothes as said clothes are dried; said adjustment means including means for allowing pressure to be applied to said solid fabric softener cartridge for advancing said solid fabric softener cartridge out of said cavity of said housing means as said first end of said solid softener cartridge is worn down by contact with said clothes as said clothes are dried.

2. The fabric softener dispenser of claim 1 in which said housing means includes an elongated housing member having a first end and a second end, said cavity of said housing means having a first end at said first end of said housing member and having a second end at said second end of said housing member.

3. The fabric softener dispenser of claim 2 in which said attachment means is coupled to said second end of said housing member.

4. The fabric softener dispenser of claim 3 in which at least a portion of said clothes dryer is ferromagnetic, and in which said attachment means includes a magnet fixedly mounted to said second end of said cavity of said housing means for attaching said housing means to said portion of said clothes dryer that is ferromagnetic.

5. The fabric softener dispenser of claim 4 in which said attachment means includes a ferromagnetic cup for fixedly receiving said magnet and for being fixedly attached to said second end of said cavity of said housing means.

6. The combination with a clothes dryer and a solid fabric softener cartridge, of a fabric softener dispenser, said clothes dryer having a drying chamber for receiving clothes to be dried, at least a portion of said clothes dryer being ferromagnetic, said solid fabric softener cartridge having a first end and a second end, said fabric softener dispenser comprising:

(a) housing means for holding said fabric softener cartridge; said housing means having a cavity for receiving said second end of said solid fabric softener cartridge; said housing means including an elongated housing member having a first end and a second end, said cavity of said housing means having a first end at said first end of said housing member and having a second end at said second end of said housing member; said housing member having a first slot extending into said cavity along one side thereof and having a second slot extending into said cavity along the opposite side thereof, each of said slots having a first end adjacent said first end of said housing member and having a second end adjacent said second end of said housing member;

(b) attachment means coupled to said second end of said housing member for attaching said housing means to said clothes dryer with said first end of said solid fabric softener cartridge extending into said drying chamber of said clothes dryer for contacting said clothes as said clothes are dried; said attachment means including a magnet fixedly mounted to said second end of said cavity of said housing means for attaching said housing means to said portion of said clothes dryer that is ferromagnetic; said attachment means including a ferromagnetic cup for fixedly receiving said magnet and for being fixedly attached to said second end of said cavity of said housing means; and (c) adjustment means for allowing said solid fabric softener cartridge to be advanced out of said cavity of said housing means.

7. The fabric softener dispenser of claim 6 in which said adjustment means includes a rod for extending through said first and second slots of said housing member for movement between said first and second ends of said first and second slots.

8. The fabric softener dispenser of claim 7 in which said solid fabric softener cartridge has a transverse slot adjacent said second end thereof substantially halfway thereacross for receiving said rod of said adjustment means.

9. The fabric softener dispenser of claim 8 in which said rod of said adjustment means has a first end and a second end; and in which said adjustment means includes a first grip member for being attached to said first end of said rod and a second grip member for being attached to said second end of said rod.

10. The fabric softener dispenser of claim 9 in which said first grip member is fixedly attached to said first end of said rod, and in which said second grip member is movably coupled to said second end of said rod for movement between first and second positions, said adjustment means being freely movable along said slots when said second grip member is in said second position.

11. The fabric softener dispenser of claim 10 in which said housing means includes a plurality of protuberances spaced along the edge of each of said slots, said adjustment means being held substantially fixed by said protuberances when said second grip member is in said first position.

12. The fabric softener dispenser of claim 11 in which said second end of said rod is threaded and in which said second grip member has a threaded aperture for being screwably attached to said second end of said grip member.

13. The fabric softener dispenser of claim 11 in which said adjustment means includes a spring movably attaching said second grip member to said rod.

14. The fabric softener dispenser of claim 8 in which said solid fabric softener cartridge has a tab between said slot and said second end thereof, said tab extending substantially halfway from the bottom of said slot to the outer circumference of the remainder of said solid fabric softener cartridge.

15. The combination with a clothes dryer and a solid fabric softener cartridge, of a fabric softener dispenser, said clothes dryer having a drying chamber for receiving clothes to be dried and a loading door for allowing clothes to be loaded into and removed from said drying chamber, at least a portion of said loading door being ferromagnetic, said solid fabric softener cartridge including an elongated cylinder having a first end and a second end and having a transverse slot thereacross substantially adjacent said second end, said fabric softener dispenser comprising:

a) housing means for holding said solid fabric softener cartridge; said housing means having a cavity for receiving said second end of said solid fabric softener cartridge; said housing means including an elongated housing member having a first end and a second end, said cavity of said housing means having a first end at said first end of said housing member and having a second end at said second end of said housing member; said housing member having a first slot extending into said cavity along one side thereof and having a second slot extending into said cavity along the opposite side thereof, each of said slots having a first end adjacent said first end of said housing member and having a second end adjacent said second end of said housing member; said housing means including a plurality protuberances spaced along the edge of each of said slots;

b) attachment means for attaching said housing means to said clothes dryer with said first end of said solid fabric softener cartridge extending into said drying chamber of said clothes dryer for contacting said clothes as said clothes are dried; said attachment means including a ferromagnetic cup for being fixedly attached to said second end of said cavity of said housing means; said attachment means including a magnet fixedly mounted in said ferromagnetic cup for attaching said housing means to said portion of said clothes dryer that is ferromagnetic; and c) adjustment means for allowing said solid fabric softener cartridge to be advanced out of said cavity of said housing means; said adjustment means including a rod for extending through said slot of said solid fabric softener cartridge and through said first and second slots of said housing member for movement between said first and second ends of said first and second slots; said rod of said adjustment means having a first end and a second end; said adjustment means including a first grip member for being attached to said first end of said rod and a second grip member for being attached to said second end of said rod; said first grip member being fixedly attached to said first end of said rod, said second grip member being movably coupled to said second end of said rod for movement between first and second positions, said adjustment means being freely movable along said slots when said second grip member is in said second position; said adjustment means being held substantially fixed by said protuberances when said second grip member is in said first position.

16. The combination with a clothes dryer of a fabric softener dispenser, said clothes dryer having a drying chamber for receiving clothes to be dried and a loading door for allowing clothes to be loaded into and removed from said drying chamber, at least a portion of said loading door being ferromagnetic, said fabric softener dispenser comprising:

a) a solid fabric softener cartridge including an elongated cylinder having a first end and a second end and having a transverse slot thereacross substantially adjacent said second end, and including a tab between said slot and said second end of said cylinder, said tab extending substantially halfway from the bottom of said slot to the outer circumference of the remainder of said cylinder;

b) housing means for holding said solid fabric softener cartridge; said housing means having a cavity for receiving said second end of said solid fabric softener cartridge; said housing means including an elongated housing member having a first end and a second end, said cavity of said housing means having a first end at said first end of said housing member and having a second end at said second end of said housing member; said housing member having a first slot extending into said cavity along one side thereof and having a second slot extending into said cavity along the opposite side thereof, each of said slots having a first end adjacent said first end of said housing member and having a second end adjacent said second end of said housing member;

c) attachment means for attaching said housing means to said clothes dryer with said first end of said solid fabric softener cartridge extending into said drying chamber of said clothes dryer for contacting said clothes as said clothes are dried; said attachment means including a magnet for removably attaching said housing means to said portion of said clothes dryer that is ferromagnetic; and d) adjustment means for allowing said solid fabric softener cartridge to be advanced out of said cavity of said housing means; said adjustment means including a rod for extending through said slot of said solid fabric softener cartridge and through said first and second slots of said housing member for movement between said first and second ends of said first and second slots; said rod of said adjustment means having a first end and a second end; said adjustment means including a first grip member for being attached to said first end of said rod and a second grip member for being attached to said second end of said rod; said first grip member being fixedly attached to said first end of said rod, said second grip member being movably coupled to said second end of said rod for movement between first and second positions, said adjustment means being freely movable along said slots when said second grip member is in said second position; said adjustment means being held substantially fixed in place on said housing means when said second grip member is in said first position.

17. The combination with a clothes dryer and a solid fabric softener cartridge, of a fabric softener dispenser, said clothes dryer having a drying chamber for receiving clothes to be dried, said solid fabric softener cartridge having a first end and a second end, said fabric softener dispenser comprising:

(a) housing means for holding said solid fabric softener cartridge; said housing means having a cavity for receiving said second end of said solid fabric softener cartridge; said housing means including an elongated housing member having a first end and a second end, said cavity of said housing means having a first end at said first end of said housing member and having a second end at said second end of said housing member; said housing member having a first slot extending into said cavity along one side thereof and has a second slot extending into said cavity along the opposite sides thereof, each of said slots having a first end adjacent said first end of said housing member and having a second end adjacent said second end of said housing member;

(b) attachment means coupled to said second end of said housing member for attaching said housing means to said clothes dryer with said first end of said solid fabric softener cartridge extending into said drying chamber of said clothes dryer for contacting said clothes as said clothes are dried; and (c) adjustment means for allowing said solid fabric softener cartridge to be advanced out of said cavity of said housing means.

* * * * *